US009003603B2

(12) United States Patent
Zimmer et al.

(10) Patent No.: US 9,003,603 B2
(45) Date of Patent: Apr. 14, 2015

(54) PNEUMATIC PIVOTING FIXTURE WITH FRICTION ELEMENT

(71) Applicants: Guenther Zimmer, Rheinau (DE); Martin Zimmer, Rheinau (DE)

(72) Inventors: Guenther Zimmer, Rheinau (DE); Martin Zimmer, Rheinau (DE)

( * ) Notice: Subject to any disclaimer, the term of this patent is extended or adjusted under 35 U.S.C. 154(b) by 0 days.

(21) Appl. No.: 13/731,187

(22) Filed: Dec. 31, 2012

(65) Prior Publication Data

US 2013/0125343 A1 May 23, 2013

Related U.S. Application Data

(63) Continuation-in-part of application No. PCT/DE2011/001421, filed on Aug. 25, 2011.

(30) Foreign Application Priority Data

Jul. 5, 2010 (DE) ..... 10 2010 026 128

(51) Int. Cl.
*E05D 11/08* (2006.01)
*E05C 17/30* (2006.01)

(52) U.S. Cl.
CPC ..... *E05D 11/081* (2013.01); *E05C 17/30* (2013.01); *E05D 11/08* (2013.01)

(58) Field of Classification Search
CPC ..... E05C 17/30; E05D 11/08–11/084
USPC ..... 16/49, 50, 68, 64, 65, 63, 341, 337, 16/286, 289, 82, 85
See application file for complete search history.

(56) References Cited

U.S. PATENT DOCUMENTS

| | | | | | |
|---|---|---|---|---|---|
| 1,131,121 | A | * | 3/1915 | Daly | 16/68 |
| 3,086,804 | A | * | 4/1963 | Lewin | 292/275 |
| 3,480,247 | A | * | 11/1969 | Waner | 292/275 |
| 3,555,591 | A | * | 1/1971 | Sogoian | 16/49 |
| 3,765,053 | A | * | 10/1973 | Anweiler | 16/49 |
| 4,087,883 | A | * | 5/1978 | Amdal | 16/82 |
| 4,113,071 | A | * | 9/1978 | Muller et al. | 188/282.8 |
| 4,190,274 | A | * | 2/1980 | Gross et al. | 292/338 |
| 4,230,309 | A | * | 10/1980 | Schnitzius | 267/120 |
| 4,240,619 | A | * | 12/1980 | Wirges et al. | 267/64.11 |
| 4,383,595 | A | * | 5/1983 | Schnitzius | 188/281 |
| 4,462,623 | A | * | 7/1984 | Grant | 292/175 |
| 4,777,698 | A | * | 10/1988 | Lord | 16/66 |
| 4,813,100 | A | * | 3/1989 | King | 16/49 |
| 5,157,806 | A | * | 10/1992 | Wartian | 16/66 |
| 5,507,070 | A | * | 4/1996 | Spyche et al. | 16/49 |
| 6,081,965 | A | * | 7/2000 | Kupfer | 16/86 R |
| 6,397,434 | B1 | * | 6/2002 | Cheal et al. | 16/370 |
| 7,428,953 | B2 | * | 9/2008 | Kneip et al. | 188/322.15 |

(Continued)

FOREIGN PATENT DOCUMENTS

| | | |
|---|---|---|
| DE | 1 932 797 | 2/1966 |
| DE | 7147342 | 3/1972 |

(Continued)

*Primary Examiner* — Jeffrey O Brien
(74) *Attorney, Agent, or Firm* — Klaus S. Bach

(57) ABSTRACT

In a pivot fixture for pivotable parts, comprising a guide unit with a guide tube and an arrest unit with an engagement rod slidably disposed in the guide tube, the engagement rod is provided with control cam structures and an expansion body with a friction surface is slidably disposed on the engagement rod, the friction surface being arranged adjacent an inner wall section of the guide tube for engagement with the wall section upon expansion of the expansion body by the engagement rod.

5 Claims, 4 Drawing Sheets

(56) References Cited

U.S. PATENT DOCUMENTS

| | | | | |
|---|---|---|---|---|
| 7,797,796 | B2 * | 9/2010 | Migli | 16/366 |
| 8,082,629 | B2 * | 12/2011 | Migli | 16/366 |
| 8,615,846 | B2 * | 12/2013 | Wheeler et al. | 16/82 |
| 2001/0007163 | A1 * | 7/2001 | Alonso | 16/58 |
| 2003/0051312 | A1 * | 3/2003 | Hoffmann et al. | 16/50 |

FOREIGN PATENT DOCUMENTS

| | | | |
|---|---|---|---|
| DE | 2540648 | * | 3/1977 |
| DE | 44 42 547 | | 6/1996 |

* cited by examiner

PNEUMATIC PIVOTING FIXTURE WITH FRICTION ELEMENT

This is a Continuation-In-Part application of pending international patent application FCT/DE2011/001421 filed Jul. 5, 2011 and claiming the priority of German patent application 10 2010 026 128.9 filed Jul. 5, 2010.

BACKGROUND OF THE INVENTION

The invention resides in a pivoting fixture for pivotable components including at least one guide unit with a guide tube and an arresting unit guided in the guide tube as well as an arresting rod.

Pivot fixtures are used for example for pivoting open windows or doors permitting to secure them in their open position that is prevent them from being unintentionally closed.

It is the object of the present invention to provide a pivot fixture which, when installed, permits a noiseless rapid opening and closing of the pivotable part as well as an essentially stepless position adjustment.

SUMMARY OF THE INVENTION

In a pivot fixture for pivotable parts, comprising a guide unit with a guide tube and an arrest unit with an engagement rod slidably disposed in the guide tube, the engagement rod is provided with control cam structures and an expansion body with a friction surface is slidably disposed on the engagement rod, the friction surface being arranged adjacent an inner wall section of the guide tube for engagement with the wall section upon expansion of the expansion body by the engagement rod.

The invention will become more readily apparent from the following description of an exemplary embodiment thereof described below with reference to the accompanying drawings.

DESCRIPTION OF AN EXEMPLARY EMBODIMENT

Figure 1:
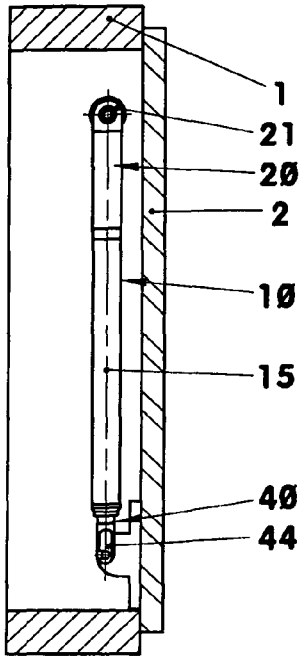
FIG. 1 shows a closed window or pivotable part with a pivot feature.
Figure 2:
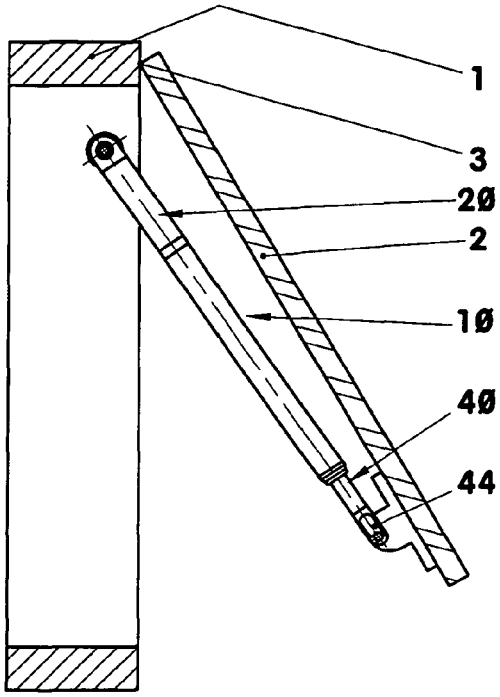
FIG. 2 shows the window in a partially pivoted open position.

FIGS. 1 and 2 show a pivot fixture 10 as installed for example on a hinged pivot window 2 or a skylight. The hinged window 2 in the example has a horizontally oriented pivot axis 3 which extends for example at one side of a travel trailer parallel to a parking place of the travel trailer. In FIG. 1*f* the hinged window is shown in a closed position and in FIG. 2 it is shown in an open position.

Figure 3:
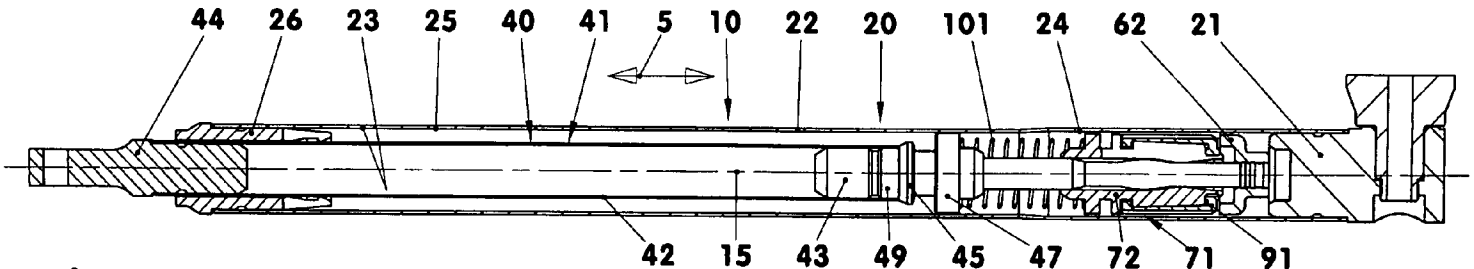
FIG. 3 shows the pivot fixture in a longitudinal cross-sectional view in a closed position of the pivotable part.

The pivot fixture 10, see FIG. 3, comprises a guide unit 20 attached to the travel trailer body 1 and an arrest unit 40 attached to the window 2. The pivot fixture 10 may also be installed in such a way that the guide unit 20 is attached to the window and the arrest unit 40 is attached to the body 1. Instead of a flap window 2, which is pivoted outwardly against the gravity forces thereof the window may also be a window hinged by a hinge with a vertical pivot axis. The pivot fixture 10 may also be used in connection with a door.

The length of the inserted fixture 10 is for example 235 mm, the stroke is for example 100 mm in the exemplary embodiment.

Figure 4:
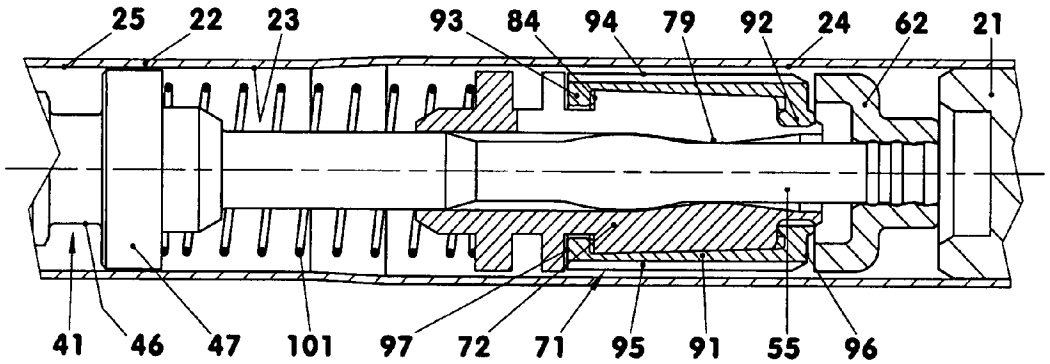
FIG. 4 is a partial sectional view of FIG. 3.

FIGS. 3 and 4 show the pivot fixture 10 in a longitudinal cross-sectional view with the window closed. The guide unit 20 comprises in the exemplary embodiment an attachment structure 21 and a guide tube 22. In the arrangement as shown in FIGS. 1 and 2, the guide attachment 21 is attached at the body 1.

The attachment structure 21 is inserted into the guide tube 22 and closes the front end thereof. The guide tube 22 has in the exemplary embodiment a constant wall thickness and, at least at its inner wall 23, two cylindrical sections 24, 25 of different diameters with smooth transitions. The length of the widened area (24) of the inner wall 23 of the attachment structure 21 is for example 25% of the length of the guide tube 22. The diameter of the widened area 24 is for example 4% greater than the diameter of the adjustment area 25.

Figure 5:
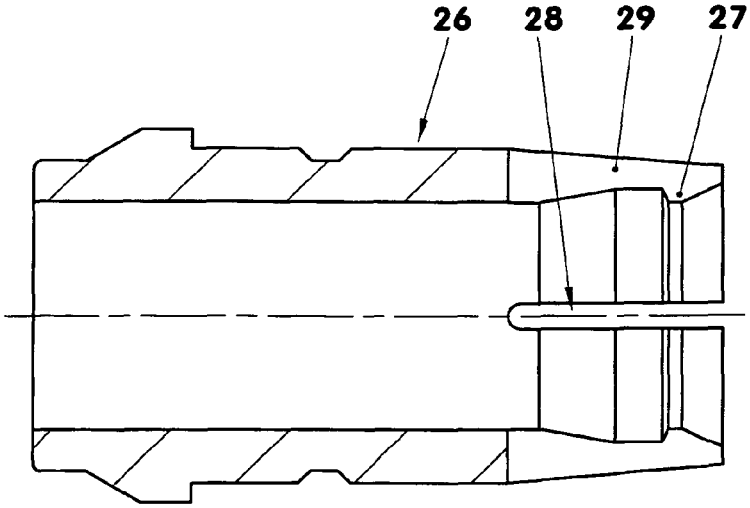
FIG. 5 is a cross-sectional view of a guide sleeve.

The adjustment area 25 is provided at the end opposite the attachment structure 21 with a guide sleeve 26. It is shown in FIG. 5 as a single component. This sleeve 26 is firmly engaged in the guide tube 22 and extends around the arrest unit 40. At one end, it is provided with a locking ring 27. In the exemplary embodiment, the locking ring comprises four segments 29, which are separated by axial gaps 28. The individual segments 29 are elastically deformable and can engage the arrest unit 40 when extended.

The arrest unit 40 comprises an engagement rod 41 and an expansion body 71. The engagement rod 41 consists for example of a cylindrical section 42, a carrier section 43 connected to the cylindrical section 42 and a mounting member 44. Those sections 42-44 may be firmly interconnected for example in a force and/or form-locking manner. The carrier section 43 is for example pressed into the tubular cylindrical section 42. With the pivot fixture 10 installed, the mounting member 44 is for example connected to the window 2. The engagement rod 41 may also be in the form of a single piece.

Figure 6:
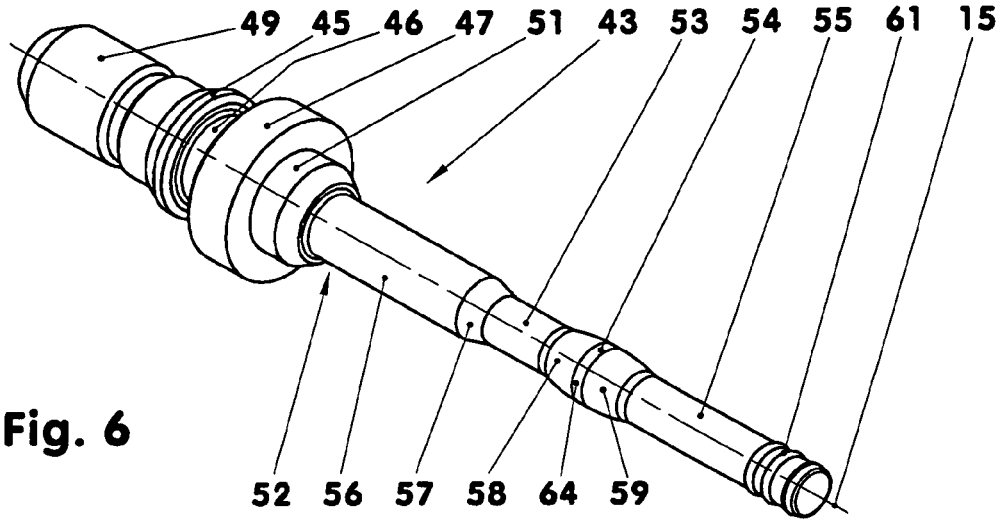
FIG. 6 shows a support section of the fixture.
Figure 7:
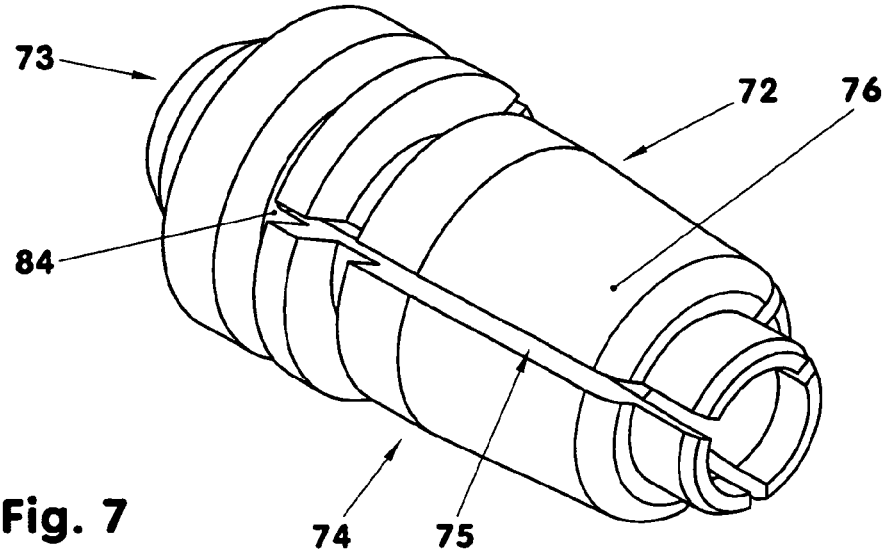
FIG. 7 shows the base body.

The carrier section 43, see FIG. 6, comprises a stop flange 45, an annular groove 46, a support flange 47 and an annular bulge 54. The stop flange 45 delimits the installation area of the carrier section 43 by which it is accommodated in the cylindrical, section 42 after installation.

The support flange 47 together with a cylindrical guide ring 51 forms in the assembled state of the fixture a support structure for a spring 101, see FIG. 3.

Adjacent the support flange 47, there is a control area 52 of the carrier section 43. Its length corresponds about to half the stroke length of the pivot fixture 10. This control area 52 includes a constriction 53, the annular bulge 54 which forms for example a control cam arranged in the longitudinal direction 15 of the pivot fixture 10 and a guide section 55.

The length of the constriction 53 is for example one fifth of the length of the control area 52. In this area, the diameter of the carrier section 43 is for example 75% of the diameter of the guide area 56 of the support flange 47. The length of the guide area 56 is for example 15% of the stroke of the arrest unit 40 relative to the guide unit 20. This corresponds for example to the outer diameter of the guide tube 22. The transition 57 of the constriction to the guide section 56 is for example cone-shaped. The tip angle of the virtual cone is for example 30%. But a continuous transition 57 may also be provided.

The annular bulge 54 acting as a control cam is shown in the exemplary embodiment to foe symmetrical with respect to a plane extending normal to the center line 63. It has a central cam surface area 64 joined in each longitudinal direction by a control flank 58, 59. The two control flanks 58, 59 are for example steadily differentiate surfaces which change over tangentially into the adjacent surfaces 53, 54, 55. The control flanks 58, 59 may also be in the form of outer cone surfaces.

The length of the control cam 54 corresponds in the exemplary embodiment to its diameter which corresponds about to the diameter of the guide area 56.

The control cam 54 may also foe in the form of a section of an annular bulge. This section may extend for example over 10 angular degrees. It is also possible to provide several circumferentially displaced control cams 54.

The guide section 55 has in the shown embodiment a constriction 53. Its length corresponds for example to the outer diameter of the guide tube 22. At its end, it is provided with engagement grooves 61 which accommodate a disc-like stop member 62.

The expansion body 71 is disposed between the support flange 47 and the stop member 62 on the carrier section 43 of the arrest unit 40. Here, it supports the end of the spring 101 remote from the support flange 47. The expansion body 71 extends in the exemplary embodiment around a base body 72 and a friction element 91.

Figure 8:
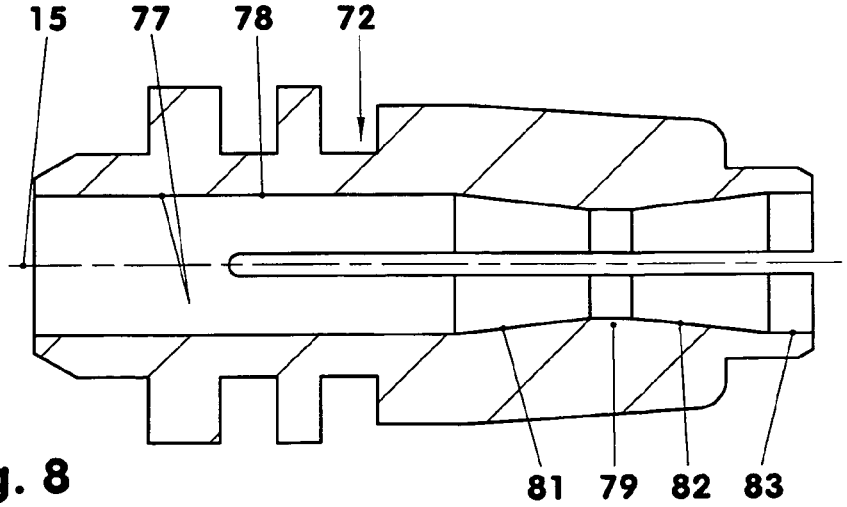
FIG. 8 is a cross-sectional view of the base body of FIG. 7.

FIG. 4 shows the base body 72 in an isometric view and FIG. 8 shows the base body 72 in a longitudinal sectional view. The length of the base body 72 is for example one fourth of the stroke of the arrest unit 40 relative to the guide unit 20. The base body has an annular flange area 73 on which the spring 101 is supported and an expansion area 74. The latter comprises for example three elastically deformable expansion wings 76 which are separated from each other by parallel gaps 75. The expansion wings 76 may also be connected to the annular flange area 73 by flexible joint structures. The gaps 75 are arranged parallel to a virtual center line 15 of the pivot fixture 10. Their length is 80% of the length of the base body 72.

The inner wall 77 of the base body 72 comprises a cylindrical section 78 and an inner constricted area 79. When the base body 72 is not deformed, the inner diameter of the cylindrical body section 78 is for example a few tenths of a millimeter larger than the diameter of the guide area 56. The diameter of the constricted area 79 is less than the diameter of the guide area 56. In the exemplary embodiment, the diameter of the constricted area 79 is larger, by two tenths of a millimeter than the diameter of the constriction 53. The constricted area 79 forms a rod cover 79 whose flank surface areas 81, 82 are for example continuously differentiable surface segments 81, 82. The surface segments 81, 82 may also be cone-shaped. The constricted area 79 may be a segment of an inner. Also the base body 72 may have several constricted areas at the inner walls thereof.

The outer diameter of the base body 72 in the annular flange area is for example 95% of the inner diameter of the guide tube 22.

Figure 13:
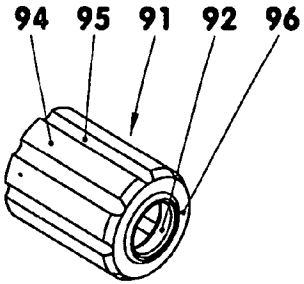

As shown in FIGS. 4 and 13, in the exemplary embodiment the friction element 91 is a pot-shaped sleeve with a mounting ring 92 and a support ring 93. The support ring 93 is seated for example in an annular groove 84 of the base body 72. The distance between the support ring 93 and the mounting ring 92 corresponds for example to the inner diameter of the guide tube 22. The length of the friction element 91 is for example two thirds of the length of the base body 72.

The friction element 91 may for example have an end face which is essentially in radial alignment with the end of the base body 72 opposite the spring 101. When not pressurized, the friction element 91 has an outer diameter which is for example the same as the inner diameter of the guide tube 22.

In the exemplary embodiment, the circumferential surface of the friction element 91 is a friction surface 94. This radially outwardly facing friction surface 94 has for example eight axial grooves 95. They form communication paths between the two front face areas 96, 97 of the friction element 91. In the representation of FIG. 3, the friction element 91 does not abut the widened area 24 of the inner wall 23.

During assembly for example first the engagement rod 41 is put together. After the expansion body 72 and the friction element 91 have been installed, the disc-like stop member 62 can be mounted onto the carrier section 43. The guide sleeve 26 can foe disposed on the engagement rod 41. After installation of the arrest unit 40, the constricted, area 79 surrounds the expansion body 72 surrounds the guide section 55 of the arrest rod 41.

Next, the arrest unit 40 pre-assembled in this way is inserted into the guide tube 22. In the process, the guide sleeve 26 may be attached in the guide tube 22. Before or after the installation of the arrest unit 40, the attachment structure 21 may be mounted to the guide tube 22.

The pivot fixture 10 preassembled in this way is then—for example as shown in FIG. 1—connected via the guide unit 20 to the body and via the arrest unit 40 to the pivot window of a travel trailer or a motor home.

With the window 2 closed, the pivot fixture 10 is shortened, see FIGS. 1 and 3. For opening the window 2, the operator can—after unlocking the window if necessary—push the window from the inside or pull it from the outside outwardly.

During opening of the window 2, the arrest unit 40 is moved relative to the guide unit 20 as shown in FIG. 3 to the left. This relative movement occurs against a small friction resistance which is caused by the guide sleeve 26 and the friction element 91 sliding along the guide tube 22.

Figure 9:
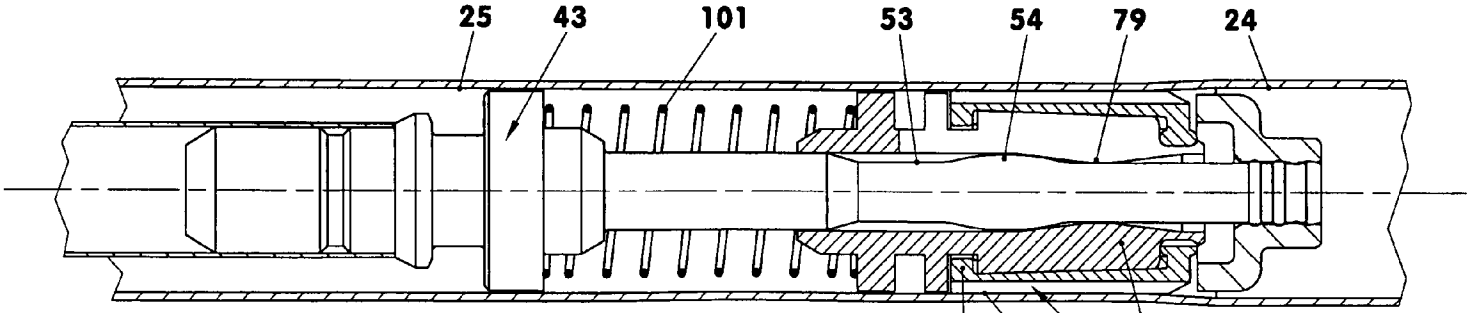
FIG. 9 shows the pivot fixture during opening.

FIG. 9 shows in a partial longitudinal cross-section, the pivot fixture 10 in a partially extended position but not locked by the arresting unit 40. The expansion body 71 is now in the adjustment area 25 of the guide tube 22. The friction surface 94 is in contact with the inner wall 23 of the guide tube 22.

Figure 10:
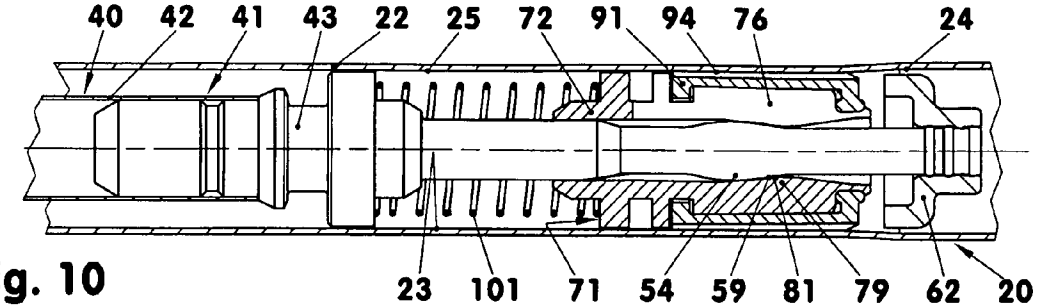
FIG. 10 is a cross-sectional view of the fixture in an arrest position.

When the window is now released by the operator, the weight of the window 2 then compresses the arresting unit 40 relative to the guide unit 20 whereby the friction element is radially expanded and engages the inner wall 23 of the guide tube 22 in a force-locking manner. The base body 72 is now held, in its position relative to the guide unit 20 as shown in FIG. 10. Upon continued compression, the pivot feature 10 is further compressed whereby the engagement rod 41 is further moved into the base body 72. The distance of the stop member 62 from the base body 72 is thereby increased so that the control, flank 58 adjacent the annular bulge 54 slides along the flank surface section 82 adjacent the constricted area 79. The expansion wings 76 are thereby elastically deformed and radially pressed apart. The friction element 91 is widened so that the friction surface 92 is pressed onto the inner wall 23 of the guide tube 22 with an increased force. The expansion body 71 consequently acts as a ram which is controlled by the annular bulge 54. The position of the window 2 is now secured by the force locking engagement between the ram 71 and the guide tube 22. The window cannot move to a closed, position.

If the window 2 is now further opened the arrest unit 40 and the guide unit 20 are pulled even further apart. The engagement rod 41 slides along the expansion body 71 which initially is retained by the guide tube 22. Hereby the constricted area 79 is moved to the area of the guide section 55. The spring 101 supports the movement of the expansion body 71 relative to the engagement rod 41. The expansion wings 76 and the friction element 91 are elastically returned to their original shape as shown in FIG. 9. The force locking engagement is eliminated. The guide unit 20 and the arrest unit 40 can now be moved further apart with little resistance.

Figure 11:
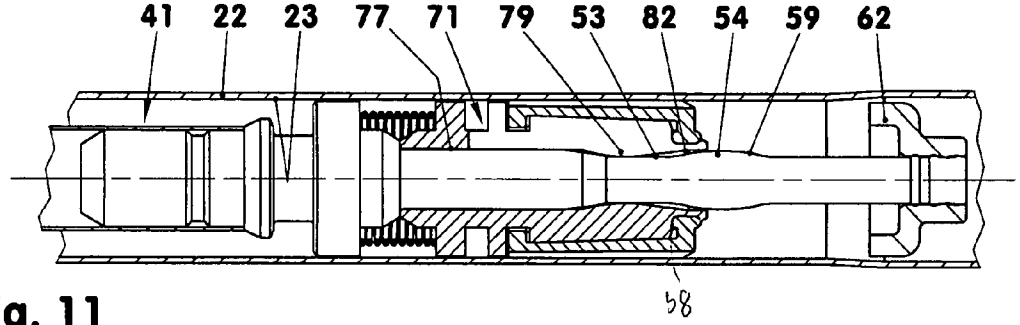
FIG. 11 is a partial cross-sectional view shows the fixture in a position in which the pivotable part is closed.

For closing the window 2 out of the force-locked position, the pivot fixture is farther compressed. The force applied for closing the window is greater than the gravity force of the window 2. The expansion body 71 is now pressed further onto inner wall 23 of the guide tube 22. The engagement rod 41 slides along the expansion body 71 until the constricted, area 79 radially abuts the annular bulge 54. The expansion wings 76 and the friction element 91 are now maximally deformed. Upon further compression of the pivot fixture 10, the annular bulge 54 slides further along the inner wall 77 of the expansion body 71. It then reaches the area of the flank surface section 82. For example at the same time, the constricted area 79 reaches the control flank 58 of the engagement rod 41. In the representation of FIG. 11, the expansion body 71 is disposed in the constriction area 53. The expansion body 71 is now elastically re-deformed. The engagement pressure of the friction element 31 to the inner wall 23 of the guide tube 22 is reduced. The distance between the stop member 62 and the base body 72 is further increased. The arrest unit 40 can now be further moved into the guide unit 20 taking along the expansion body 71.

If the window is closed only partially, the force locking engagement as described above is re-established.

Upon complete closing of the window 2, with a residual opening angle of for example five degrees, the friction element 91 reaches the widened area 24 of the inner wall 23 of the guide tube 22, see FIGS. 3 and 4. The friction element is now released from the inner wall 23. The sliding friction of the engagement body 71 relative to the guide unit 20 is eliminated. The spring 101 presses the expansion body 71 against the stop member 62. The window 2 can now be closed without resistance—except for the friction between the guide sleeve 26 and the engagement rod 41.

Figure 12:
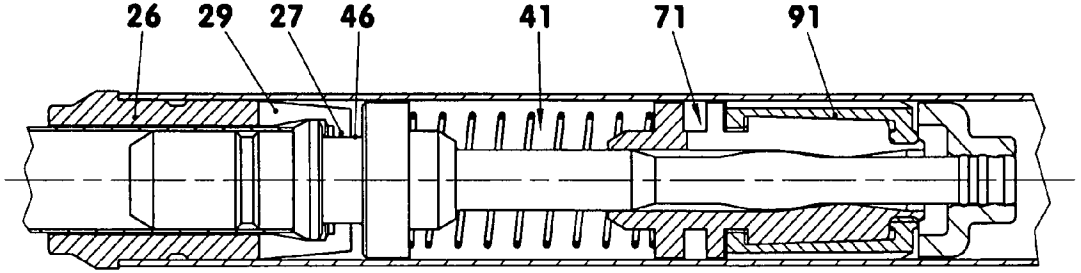
FIG. 12 shows the fixture in a position in which the pivotable part is fully opened and, FIG. 13 shows a friction element in a perspective view.

The window can be arrested at any angle which is greater than the mentioned residual opening angle. If the window 2 is fully opened, the guide sleeve 26 engages with its locking ring 27 the annular groove 46 between the stop flange 45 and the support flange 47, see FIG. 12. When fully opened, the pivot fixture 10 is arrested in a form-locking manner.

When the window is to be closest out of this position first, the segments 29 of the locking ring 27 are elastically deformed. They bend outwardly and release the arrest unit 40 from the guide unit 20. The further closing proceeds as described above.

The expansion body 71 is slidable on the engagement rod 41 between two end positions. The two end positions are formed, in the exemplary embodiment by the guide ring 51 and the stop member 62.

With the pivot fixture according to the invention, the tilt angle of the window 2 can be steplessly adjusted from within or without. If two travel trailers or motor homes are parked for example closely together, damage to a window 2 can easily be prevented, by a rapid closing of the window 2. The operator does not need to touch the pivot fixture 10.

In the pivot fixture 10 as described, the control arrangement comprising the annular bulge 54 and the expansion body 71 may be arranged in a common partial segment of the circular cross-sectional, area.

The guide unit 20 as well as the arrest unit 40 may have a square, rectangular, multi-cornered, oval, elliptical, etc. cross-section. For example in an embodiment of the pivot fixture 10 with a square cross-section the control arrangement of cams and the expansion body may be arranged only at one side whereas the other three sides are used for guiding the guide unit and the arrest unit.

LISTING OF REFERENCE NUMERALS

| | |
|---|---|
| 1 | Body |
| 2 | Hinged pivot window |
| 3 | Pivot axis |
| 5 | Longitudinal direction |
| 10 | Pivot fixture |
| 15 | Centerline |
| 20 | Guide unit |
| 21 | Attachment structure |
| 22 | Guide tube |
| 23 | Inner wall |
| 24 | Widened area |
| 25 | Adjustment area |
| 26 | Guide sleeve |
| 27 | Locking ring |
| 28 | Axial gap |
| 29 | Segments |
| 40 | Arrest unit |
| 41 | Engagement rod |
| 42 | Cylindrical section |
| 43 | Carrier section |
| 44 | Mounting member |
| 45 | Stop flange |
| 46 | Annular groove |
| 47 | Support flange |
| 49 | Insert area |
| 51 | Guide ring |
| 52 | Control area |
| 53 | Constriction area |
| 54 | Annular bulge, cam structure |
| 55 | Guide section |
| 56 | Guide area |
| 57 | Transition |
| 58 | Control flank |
| 59 | Control flank |
| 61 | Engagement groove |
| 62 | Disc-like stop member |
| 63 | Center line |
| 64 | Cam surface area |
| 71 | Expansion body |
| 72 | Base body |
| 73 | Annular flange area |
| 74 | Expansion area |
| 75 | Gaps |
| 76 | Expansion wings |
| 77 | Inner wall |
| 78 | Cylindrical section |
| 79 | Constricted area |
| 81 | Flank surface section |
| 82 | Flank surface section |
| 83 | Outer area |
| 84 | Annular groove |
| 91 | Friction element |
| 92 | Mounting ring |
| 93 | Support ring |
| 94 | Friction surface |
| 95 | Axial grooves |
| 96 | Front face area |
| 97 | Front face area |
| 101 | Spring |

What is claimed is:

1. A pivot fixture for pivotable parts comprising a guide unit (20) with a guide tube (22) and an arrest unit (40) with an engagement rod (41) slidably disposed in the guide tube (22), the guide tube (22) having an adjustment area (25), and the engagement rod (41) being provided with conical control cam structures (54) oriented in a longitudinal direction (5) and formed on, or fixed to, the engagement rod (41) for movement therewith, an expansion body (71) with a friction surface (94) slidably disposed on the engagement rod (41) and the friction surface (94) being arranged adjacent an inner wall section (23) of the guide tube (22) and abutting the inner wall section (23) when the expansion body (71) is disposed in the adjustment area (25), the control cam structure (54) having inclined control surfaces (58, 59) which are conically inclined in opposite directions so as to form a central bulge and the expansion body (71) having a constricted area (79) with inclined engagement surfaces (81, 82) extending axially from the constricted area (79) so as to form widening conical engagement surfaces extending in opposite directions from the constricted area (79) through which the engagement rod (41) with the control cam structure (54) extends for expanding the expansion body (71) into engagement with the guide tube (20) when the control cam structure (50) enters the expansion body (71) from either side of the constricted area (79) thereof and a return spring (101) arranged between, the expansion body (71) and the engagement rod (41) on which the expansion body (71) is axially supported.

2. The pivot fixture according to claim 1, wherein the inner wall of the guide tube (22) includes a widened area (24) next to one end position thereof.

3. The pivot fixture according to claim 1, wherein the guide unit (20) includes a locking ring (27) to provide for a form-locking engagement of the arrest unit (40) in an end position thereof.

4. The pivot fixture according to claim 1, wherein the expansion body (71) is axially movable on the engagement rod (41) between two end positions.

5. The pivot fixture according to claim 1, wherein the friction surface (94) is part of a friction element (91).

* * * * *